US005455114A

United States Patent [19]

Ohmory et al.

[11] Patent Number: 5,455,114

[45] Date of Patent: Oct. 3, 1995

[54] WATER SOLUBLE POLYVINYL ALCOHOL-BASED FIBER

[75] Inventors: Akio Ohmory; Tomoyuki Sano, both of Kurashiki; Syunpei Naramura, Tukubogun; Satoru Kobayashi, Kurashiki, all of Japan

[73] Assignee: Kuraray Co., Ltd., Kurashiki, Japan

[21] Appl. No.: 282,741

[22] Filed: Jul. 29, 1994

[30] Foreign Application Priority Data

Jul. 29, 1993 [JP] Japan ..... 5-188229
Jul. 29, 1993 [JP] Japan ..... 5-188230

[51] Int. Cl.[6] ..... D02G 3/00

[52] U.S. Cl. ..... 428/364; 428/394; 525/56

[58] Field of Search ..... 525/56; 428/364, 428/394

[56] References Cited

U.S. PATENT DOCUMENTS

| | | | |
|---|---|---|---|
| 3,689,469 | 5/1972 | Inskip | 525/56 |
| 4,612,157 | 9/1986 | Genba et al. | 264/185 |
| 4,713,290 | 12/1987 | Kwon et al. | 525/56 |
| 4,942,089 | 7/1990 | Genba et al. | 428/364 |
| 5,110,678 | 5/1992 | Narukawa et al. | 428/364 |
| 5,133,916 | 7/1992 | Sano et al. | 264/185 |
| 5,187,226 | 2/1993 | Kamachi et al. | 525/36 |
| 5,208,104 | 5/1993 | Ueda et al. | 428/364 |
| 5,229,057 | 7/1993 | Ohmory et al. | 264/185 |
| 5,238,995 | 8/1993 | Fukunishi et al. | 525/60 |
| 5,283,281 | 2/1994 | Taniguchi et al. | 528/56 |
| 5,340,522 | 8/1994 | Taniguchi et al. | 525/56 |

FOREIGN PATENT DOCUMENTS

| | | |
|---|---|---|
| 0327696 | 8/1989 | European Pat. Off. . |
| 1519530 | 4/1970 | Germany . |
| 53-45424 | 4/1978 | Japan . |
| 53-10174 | 4/1978 | Japan . |
| 62-28408 | 2/1987 | Japan . |
| 1-229805 | 9/1989 | Japan . |
| 3-199408 | 8/1991 | Japan . |
| 5-86503 | 4/1993 | Japan . |
| 86543 | 6/1993 | Japan . |

OTHER PUBLICATIONS

Database WPI, Derwent Publications Ltd., AN 74–88059V, JP–B–49 044 014, Nov. 26, 1994.

Database WPI, Derwent Publications Ltd., AN 77–50874Y, JP–B–53 010 174, Apr. 12, 1978.

Database WPI, Derwent Publications Ltd., AN 87–075817, JP–A–62 028 408, Feb. 6, 1987.

Database WPI, Derwent Publications Ltd., AN 91–299844, JP–A–3 199 408, Aug. 30, 1991.

Database WPI, Derwent Publications Ltd., AN 93–149543, JP–A–5 086 503, Apr. 6, 1993.

Database WPI, Derwent Publications Ltd., AN 78–40970A, JP–A–53 045 424, Apr. 24, 1978.

Database WPI, Derwent Publications Ltd., AN 74–81501V, JP–A–49 035 622, Apr. 2, 1974.

*Primary Examiner*—N. Edwards
*Attorney, Agent, or Firm*—Oblon, Spivak, McClelland, Maier & Neustadt

[57] ABSTRACT

The process of the present invention comprises wet spinning or dry-jet-wet spinning a PVA-based polymer soluble in water at not more than 100° C. while using a dope solvent and a solidifying solvent each comprising an organic solvent, wet drawing the solidified filaments, subjecting the drawn filaments to extraction treatment and then drying, and further subjecting the filaments to heat shrinking treatment under multi-stage temperature elevation condition. The water soluble fibers of the present invention obtained by this process, while having a low water dissolution temperature of not more than 100° C., have a markedly small maximum shrinkage in water and has high tensile strength and small ash content. The water soluble fibers of the present invention are suitably used for chemical lace base fabrics and blended yarns with wool or jute.

5 Claims, 1 Drawing Sheet

WATER SOLUBLE POLYVINYL ALCOHOL-BASED FIBER

BACKGROUND OF THE INVENTION

1. Field of the Invention

The present invention relates to water-soluble fibers comprising a polyvinyl alcohol ("PVA") and having excellent dimensional stability. More specifically, the present invention relates to water soluble PVA fibers which, while being readily soluble in hot water at a temperature up to 100° C., shrink only to a small extent under high humidities, as well as upon dissolution, and have high tensile strength and small ash content. These fibers, having the above features, have very good handleability and give high-quality finished products and are hence suitably used for chemical lace based fabrics, blend yarns with wool, flax or ramie and like items.

2. Description of the prior art

Known water soluble fibers include PVA-based fibers, cellulose-based fibers such as carboxymethylcellulose fiber, polyalginic acid fiber, polylactic acid fiber, polyalkylene oxide fibers and the like, and are suitably used utilizing their features. Among these water soluble fibers, PVA-based fibers are used most widely because of their high tensile strength.

Various water soluble PVA fibers have been proposed by, for example, Japanese Patent Publication Nos. 8992/1968 and 10174/1978 and Japanese Patent Application Laid-open Nos. 199408/1991, 28408/1987, 86503/1993, 45424/1978 and 229805/1989.

Of this above literature, Japanese Patent Publication No. 8992/1968 describes a process for producing a water soluble fiber which comprises conducting dry spinning of a high-concentration aqueous PVA solution. However, the fiber obtained by this process has a large shrinkage upon dissolution in water of 30% and hence chemical lace base fabrics utilizing this fiber shrink, when being dissolved in with water, to a large extent, thereby deforming the lace pattern embroidered thereon. Consequently, such base fabrics are not usable for preparing high-quality laces having fine patterns.

Japanese Patent Publication No. 10174/1978 describes a process for producing a fiber which is soluble in low temperature water, which comprises using a carboxyl group-modified PVA as raw material. However, the fiber obtained by this process has the drawback of shrinking to a large extent when absorbing moisture, when allowed to stand under high humidities. The fiber as well as finished products obtained therefrom must therefore be stored under a specific atmosphere with controlled, low-humidity.

Japanese Patent Application Laid-open No. 199408/1992 describes a process for producing a water-soluble fiber from a PVA which has low degree of a polymerization of not more than 500, in order to decrease the shrinkage of the fiber upon dissolution in water. The PVA used in this process, having a low degree of polymerization, can only give fibers having a very low strength of less than 3 g/d. Furthermore, the obtained fiber contains boric acid or a borate (in particular, low temperature soluble types of this fiber contains a large amount of boric acid or a borate), thereby causing the effluent water used for dissolving the fiber to contain a large amount of boric acid, the treatment of which requires a special process and apparatus.

Japanese Patent Application Laid-open No. 28408/1987 describes, an improvement in the spinnability of a PVA having a low degree of polymerization, which should give a fiber having small-shrinkage solubility, by employing a technique which comprises adding to the PVA a small amount of another PVA having a high degree of polymerization, thereby obtaining a PVA having both good spinnability and small-shrinkage solubility. Even with the fibers obtained by this technique, mainly containing the low-polymerization-degree PVA, a small shrinkage type of not more than 20% has a low strength of not more than 3 g/d. Such a water soluble fiber with low tensile strength has poor processability during knitting or weaving or during non-woven manufacturing. In addition, the fiber readily breaks when handled by embroidery needles upon embroidery of chemical lace on base fabrics made therefrom. Fine embroidery is impossible with such base fabrics.

Japanese Patent Application Laid-open No. 86503/1993 describes a technique having the same object as that of the present invention which is to improve the dimensional stability of a water soluble fiber under high-humidity conditions. However, the fiber actually obtained by the technique has a considerably large shrinkage, at a RH of, 80% of at least 3.5%. The fiber, like that obtained by the above process disclosed in Japanese Patent Publication No. 10174/1978, has a very serious problem in that fibers or articles processed therefrom must be stored under low-humidity conditions.

Japanese Patent Application Laid-open No. 45424/1978 describes a process for producing a water soluble fiber having a small shrinkage in water at not more than 50° C., which comprises wet spinning an aqueous solution of a PVA having a low saponification degree into a concentrated aqueous solution of a salt such as sodium sulfate and then drawing the obtained as-spun fiber in a low draw ratio. However, the fiber obtained by this process, which uses a high concentration aqueous salt solution, as a coagulating bath, contains a large amount of the salt adhering thereto. Washing with water then becomes necessary to remove this salt from the fiber, but complete washing is very difficult, since the fiber itself is water soluble. Thorough washing would dissolve the fiber surface and cause the fibers to stick together, so that fibers that have small ash content and do not stick with each other cannot be obtained. Besides, the fiber obtained by this process, while having a small shrinkage in water at not more than 50° C., shows a large shrinkage at a higher temperature just before dissolution, and therefore has poor dimensional stability.

Japanese Patent Application Laid-open No. 229805/1989 describes a process for producing a water soluble PVA fiber having high tensile strength, which comprises dry-jet-wet spinning a solution of a PVA having a low saponification degree in an organic solvent such as dimethyl sulfoxide (hereinafter referred to as "DMSO") into a solidifying bath such as methanol having a solidifying function and then drawing the solidified fiber in a high draw ratio. However, the fiber obtained by this process, in which the strain due to the high-ratio drawing still remains, shows, when kept under high humidities, a large shrinkage due to moisture absorption and also shrinks to a large extent upon water dissolution, and thus has poor dimensional stability. The object of the technique described in this laid-open application is not to provide a fiber having good dimensional stability but, rather, from the description that the fiber is suitably used for preventing side leaks of disposable diapers, to provide a fiber having a very high shrinkage when wetted.

In the field of chemical lace base fabrics, it is required that fibers constituting the fabrics be soluble in low-temperature water. However, such low-temperature soluble fibers shrink by absorption of moisture in the air and should therefore be stored in a low-humidity atmosphere, which fact makes storage and control of the fibers and fabrics made therefrom very difficult. If water soluble fibers have a low tensile strength, they readily break by action of the needle upon embroidery on the base fabric made therefrom, whereby fine-design embroidery, i.e. high-grade embroidery cannot be obtained. Furthermore, with water soluble fibers shrinking to a large extent upon dissolution, the obtained embroidered patterns deform at the same time, so that high-grade embroidery cannot be obtained.

As another end-use of water soluble fibers is in a process which comprises preparing blended yarns or blend twisted yarns of water soluble fibers with wool, flax or fibers, processing the obtained yarns into woven or knit fabrics and then dissolving the water soluble fiber component thereby obtaining fabrics having a unique hand or drape or improving the processability in the steps of spinning through weaving or knitting. If the water soluble fiber used for this purpose shrinks upon dissolution, which increases the apparent density of the structure containing them, their complete dissolution will become difficult. If the water soluble fibers have a low tensile strength, they tend to break during spinning through weaving or knitting, thus showing poor processability. Where the water soluble fibers have high ash content because they carry on their surface salts, boric acid or the like, such salts readily adhere to weaving or knitting machines or chemical lace manufacturing machine, thereby causing the machines to rust. Furthermore, in this case, the water used for the dissolution necessarily contains chemicals such as boric acid, which require complex post-treatment of the effluent water.

However, no known techniques have, as described above, succeeded in giving a water soluble fiber that shrinks only to a small extent upon dissolution in water and has good dimensional stability under high humidities, almost no ash content and high tensile strength.

SUMMARY OF THE INVENTION

Accordingly, one object of the present invention is to provide a water soluble fiber that has not been obtained by conventional techniques, i.e. one that does not substantially shrink when kept under high humidities and shrinks only to a small extent upon dissolution in water and has almost no ash content and high tensile strength.

The present invention provides a water soluble PVA-based fiber having a water dissolution temperature (T° C.) of 0° to 100° C., a maximum shrinkage in water of not more than 20%, a tensile strength of at least 3 g/d, an ash content of not more than 1% and a dimensional change ratio, S(%), at 20° C., 93% RH satisfying the following conditions:

when $0 \leqq T \leqq 50$, $S \leqq 6-(T/10)$, and when $50 < T \leqq 100$, $S \leqq 1$.

The present invention also provides a process for producing the above fiber, which comprises the steps of:

preparing a spinning dope by dissolving a PVA having a water dissolution temperature of not more than 100° C. in a first organic solvent, wet spinning or dry-jet-wet spinning the obtained spinning dope into a second organic solvent (hereinafter referred to as "solidifying solvent") that exhibits a solidifying function for the PVA to obtain solidified fibers, wet drawing the solidified fibers in a draw ratio of 2 to 8, subjecting the wet drawn filaments to extraction of the first organic solvent With the solidifying solvent, drying the wet-drawn filaments and, if necessary, dry heat drawing the filaments, and subjecting the dried or further dry heat drawn filaments to a dry heat shrinking treatment in a shrinkage of 3 to 40% under a multi-stage temperature elevation condition at temperatures in a range of 80° to 250° C.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawing, wherein.

DETAILED DESCRIPTION OF THE PREFERRED EMBODIMENTS

Figure 1:
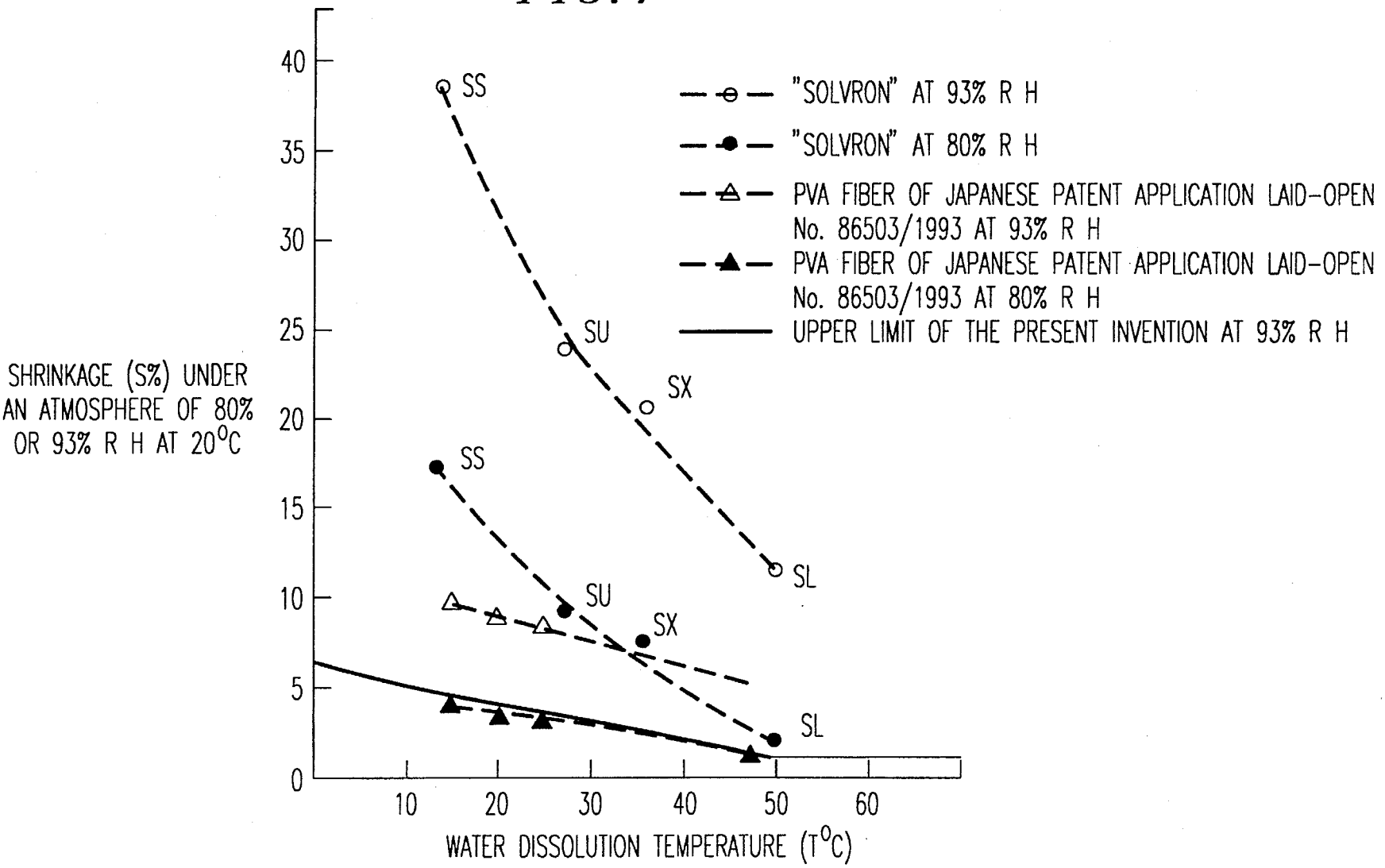
FIG. 1 is a graph showing the relationship between the water dissolution temperature and the shrinkage when kept under an atmosphere of 80% or 93% RH at 20° C., for the water soluble fibers of the present invention, those commercially available (SOLVRON-SS, SU, SX and SL, made by Nichibi Co. ) and those described in Japanese Patent Application Laid-open No. 86503/1993.

In the present invention, the term "fiber" means matter in a form such that the cross-sectional area is very small and the length very large compared to the diameter and thus includes both endless filaments and staples. "A fiber" can mean either an individual, single fiber or, generically, a fiber species from a specific polymer; for example "a PVA-based fiber" can mean fibers and/or filaments formed of a specific PVA, such as completely saponified PVA or partially saponified PVA.

Polymers usable in the present invention are PVA-based ones that, after being formed into fibers, dissolve in water at 0° to 100° C. Pure PVA's comprising 100% vinyl alcohol units are not desirable because they hardly give fibers soluble in water at 0° to 100° C. because of too high a crystallinity.

In particular, in order to obtain a fiber soluble in water at 0° to 60° C., a partially saponified PVA maybe used, which consists of vinyl alcohol units and vinyl acetate units and which has a saponification degree of less than 96 mole %, i.e. the vinyl acetate units being present in an amount of at least 4 mole %. In this case, with the saponification degree being not more than 80 mole %, the obtained fibers tend to stick together. Furthermore, the polymer constituting the fibers has low crystallinity, so that the fibers do not have good dimensional stability under high humidities and shrink to a large extent upon dissolution in water.

In order to obtain a fiber soluble in water at a temperature of 60° to 100° C., it is desirable to use a PVA-based polymer containing at least 96 mole % of vinyl alcohol units. For example, partially saponified PVA's having a saponification degree of 96 to 99.5 mole % are desirably used for this purpose. Use of a PVA having a saponification degree of at least 99.5 mole % causes high crystallization during dry heat drawing and the dry heat shrinking treatment, thereby readily giving fibers having a water dissolution temperature exceeding 100° C.

It is also possible to obtain a fiber soluble in water at a temperature lower than 60° C. by using a PVA containing units other than those from vinyl alcohol or vinyl acetate, i.e. what is known as modified PVA. In this case, it is desirable to use a modified PVA containing at least 1 mole % in particular at least 2 mole %, of modifying units, although those containing about 0.5 mole % of modifying units may sometimes be suitably used if such units have a substantial crystallization inhibiting effect. Likewise, in order to obtain a fiber soluble in water at a temperature of 60° to 100° C., it is desirable to use a modified PVA containing less than 2 mole %, preferably 0.1 to 1.0 mole % of modifying units. Examples of modifying units usable for this purpose are ethylene, allyl alcohol, itaconic acid, acrylic acid, maleic anhydride or its ring-opened product, arylsulfonic acid, vinyl esters of aliphatic acids having at least 4 carbon atom, such as vinyl pivalate, vinylpyrrolidone and compounds obtained by neutralizing part or all of the above ionic groups. These modifying units may be introduced either by copolymerization or post-reaction, and they may be distributed in the resulting polymer chain in random, block-wise or grafted form with no specific limitation. With the content of modifying units exceeding 20 mole %, the modified polymer has too low a crystallinity, thereby being unable to give a fiber with good dimensional stability according to the present invention.

The PVA-based polymers usable in the present invention preferably have an average degree of polymerization of 100 to 3,500, more preferably 300 to 3,000 and most preferably 700 to 2,500.

The water dissolution temperature (T° C.) of the water soluble fiber of the present invention is 0° to 100° C. If the temperature exceeds 100° C., it will become necessary to use a pressure vessel for the dissolution, which is dangerous upon operation and increases energy costs for the dissolution. In addition, too high a dissolution temperature makes difficult complete dissolving of the soluble fibers and, when the fibers are dissolved from blends with other insoluble fibers, causes the other fibers to be damaged or degraded. From these points of view, the water dissolution temperature is preferably not more than 60° C.

Where the water soluble fiber of the present invention is used for chemical lace base fabrics, the water dissolution temperature (T° C.) is desirably not more than 60° C., more preferably not more than 50° C. and most preferably not more than 40° C., because such low temperatures facilitate complete dissolution.

The water dissolution temperature (T° C.) referred to in the present invention means the temperature at which a fiber specimen having a length of 4 cm and loaded with 2 mg/d breaks when it is immersed in water at 0° C. and the water temperature is elevated at a rate of 2° C./min.

One of the key features of the water soluble fibers of the present invention is that the fibers have a maximum shrinkage in water of not more than 20%, which means that they have good dimensional stability upon dissolution in water. If the maximum shrinkage exceeds 20%, the following problems will occur. When a textile product comprising a mixture of the water soluble fiber of the present invention and other insoluble fiber is subjected to treatment with water to dissolve only the water soluble fiber, the textile product undergoes a very large size change, thereby deteriorating its shape and properties. In this instance, in addition to the above problem, the water soluble fiber of the present invention shrinks by absorption of water into gel-like form and hence its specific surface area becomes smaller, whereby complete dissolution takes a long time. In particular, if water soluble fibers having a high maximum shrinkage upon dissolution in water are used for a chemical lace base fabric for fine-design embroidery, the lace will deform upon the dissolution. Base fabrics using water soluble fibers having a maximum shrinkage upon dissolution in water of not more than 20% show a shrinkage of almost 0% upon dissolution of the fibers and are hence usable for preparing fine-design laces, which is of great industrial value. Likewise, blended yarns comprising water soluble fibers having a maximum shrinkage of not more than 20% and wool, flax or ramie hardly shrink upon the dissolution treatment, so that the water soluble fibers can be readily and completely dissolved.

The maximum shrinkage in water is preferably not more than 15%, more preferably not more than 10%. Conventional water soluble fibers drawn and oriented in a high draw ratio show a maximum shrinkage of as high as 70%, because oriented molecules constituting them undergo relaxation to nearly amorphous state during dissolution treatment, thereby becoming of poor solubility. However, with the water soluble fiber of the present invention, orientation and relaxation are suitably combined during the fiber manufacturing process such that relaxation upon dissolution is suppressed, so that the small shrinkage is achieved. The maximum shrinkage in water, as referred to in the present invention, means the maximum shrinkage exhibited by a fiber specimen during the measurement of the above water dissolution temperature (T° C.), during which the shrinkage of the specimen is measured at each temperature.

The next key feature of the water soluble fiber of the present invention is that, in spite of being water soluble, it has a dimensional change ratio, S(%), at 20° C., 93% RH satisfying the following conditions:

when $0 \leqq T \leqq 50$, $S \leqq 6-(T/10)$, and when $50 < T \leqq 100$, $S \leqq 1$ wherein T represents the water dissolution temperature.

That is, if T exceeds 50, S must be not more than 1; and if T is even 0, S must still be a very low value of not more than 6%. With conventional water soluble fibers having a low T, the crystals in the fibers are of loose and mobile structure, so that the fibers, when allowed to stand under a high humidity, absorb moisture and tend to shrink to a shorter fiber length in an effort to attain a higher entropy, state, i.e. less oriented structure. Accordingly, S tends to increase substantially with decreasing T. However, a high S, i.e. high dimensional change ratio under high humidity, renders it necessary to pay a great deal of attention to the humidity conditions for storing and processing the fibers, as well as the storing and handling textile products obtained therefrom. For example, when one attempts to use this type of fiber for chemical lace base fabrics, a great deal of attention should be directed to keeping and storing the fabrics before, during and after their preparation. Thus, "SOLVRON-SS" (made by Nichibi Co.), being the only commercially available PVA-based water soluble fiber having a T of not more than 20° C., is sold while being at first wrapped in a bag with low moisture permeability and then packed in a tightly sealed outside package. Furthermore, in the textile industry fiber processing techniques are generally used which comprise processing fibers while humidifying them, in order to prevent running fibers from generating static charge. However, such general techniques are not applicable to fibers that shrink to a large extent under highly humid conditions and, instead, it becomes necessary to modify manufacturing apparatus or process to a significant degree.

The water soluble fibers of the present invention, shrinking only to a very small extent by moisture absorption under high-humidity conditions, require no particular consideration in their storage or handling or the storage or handling of textile products made therefrom and can be processed through machines and the like that are used for general-purpose fibers.

In the present invention, when $0 \leqq T \leqq 50$, S is preferably less than [4–(T/15)], more preferably less than [3–(T/20)]. When $50 < T \leqq 100$, a value of S exceeding one leads to poor dimensional stability under high humidities and also upon dissolution treatment. When $50 < T \leqq 100$, preferably $S \leqq 0.67$, more preferably $S \leqq 0.5$.

The dimensional change ratio S% at 20° C. and 93% RH referred to in the present invention is determined as follows. A length of specimen is taken from a fiber sample bone dried in a dessicator. The length, $L_O$, is preferably 50.0 cm, but it may be the maximum length that can be taken if the sample is shorter than 50.0-cm. The specimen is then placed under a relaxed condition in a sealed container at 20° C., 93% RH for at least 7 days. After that, the specimen is taken out and rapidly measured for the length $L_1$ cm. S is calculated by:

$$S=(L_O-L_1)\times 100/L_O$$

When a chemical lace fabric utilizes water soluble fibers with which $S>6-(T/10)$ under the condition of $0 \leqq T \leqq 50$ or $S>1$ under the condition of $50<T \leqq 100$, the fabric shrinks and changes its size when stored under high-humidity conditions. Then, the fabric tension cannot be maintained constant during embroidery, whereby local distortions generate and the intended patterns cannot be obtained, in particular upon embroidery of fine-design patterns. In addition, the fabric after embroidery will shrink when kept under a high humidity of for example 90% RH, so that the fine-design patterns will deform. Consequently, with water soluble fibers for use in, particularly, base fabrics for high-quality, fine-design lace, the following conditions must be satisfied.

when $0 \leqq T \leqq 50$, $S \leqq 6-(T/10)$, and when $50<T \leqq 100$, $S \leqq 1$ FIG. 1 shows the relationship between the T and S under 93% RH and 80% RH of various types of commercially available water soluble fibers "SOLVRON" (made by Nichibi Co.) in comparison with the water soluble fibers of the present invention. For "SOLVRON", types SS, SU, SX and SL are available. The relationship between S and T of these types under 93% RH is shown by blank circles and that under 80% RH by black (solid) circles. From the FIGURE it is understood that the S under 93% RH becomes at least twice, in particular 3 to 5 times the value of the S of small-shrinkage fibers, that under 80% RH. The FIGURE also shows the relationship between T and S under 80% RH (solid triangles) and that between T and estimated S under 93%-RH (blank triangles), as well as that between T and S under 93% RH for a fiber according to the present invention. As is apparent from the FIGURE, the fibers according to the present invention have better dimensional stability compared with conventional water soluble fibers. By suppressing S down to such a level, the present invention has succeeded in obtaining high-grade laces with fine-design patterns, just as designed.

Still another key feature of the fibers of the present invention is that they have a tensile strength of at least 3 g/d. With water soluble fibers having a tensile strength of less than 3 g/d, problems tend to occur during knitting or weaving or during nonwoven fabric preparation, so that high-speed productivity is difficult to achieve and the resulting knit, woven or nonwoven fabrics have poor mechanical properties, thereby becoming inapplicable to a wide range of uses.

The tensile strength herein is measured on a 20 mm long specimen taken from PVA fiber in the form of a hank which has been conditioned at 20° C. and 65% relative humidity. The specimen is pulled at a rate of 20 mm/minute. By this method, a load elongation curve is obtained. From this curve, the tensile strength at breakage is "tensile strength" of the present invention expressed in g/denier (g/d).

Let us take chemical lace base fabrics used for preparing fine-design laces, where the interval of needlings for embroidery is short. If fibers constituting the fabrics have a tensile strength of less than 3 g/d, the fibers between adjacent needlings break so that the desired fine patterns cannot be embroidered. On the other hand, if the fibers have a tensile strength of at least 3 g/d, they rarely break upon embroidery so that the intended fine-design laces can be obtained. When the high-strength water soluble fibers are used for preparing blended yarns with wool, flax or ramie, the yarns prepared are effectively provided with high strength and the processability is improved to a large extent and the speed-up of spinning and weaving processes can be achieved. The tensile strength is preferably at least 4 g/d, more preferably at least 4.5 g/d and most preferably at least 5 g/d.

Yet another key feature of the water soluble fibers of the present invention is that they have an ash content of not more than 1%. If the ash content exceeds 1%, then, for example when such fibers are used for preparing chemical lace base fabrics, the corresponding inorganic compounds present in the fiber or on the surface thereof will scatter during the preparation of the fabrics or during the succeeding embroidery process. The compounds not only deteriorate the working condition, but cause excessive wear of embroidery needles and rusting of apparatuses. Furthermore, if the waste water used for dissolving off the fabrics contains for example borate ion, special treatment of the waste water will become necessary. The ash content is preferably not more than 0.2%, more preferably not more than 0.1%. The ash content herein means, when a fiber sample is heated in air at 500° C. for 8 hours to decompose organic materials completely, the residue is expressed in % by weight.

The water soluble fiber of the present invention may have any cross-sectional shape, but a simple circular shape is desirable compared with complex shapes. Conventional PVA fibers, which are obtained by dissolving a PVA in water to prepare a spinning dope solution and then wet spinning the solution into an aqueous solution of an inorganic salt such as sodium sulfate, generally have a complex shape such as dog bone. Such fibers having a complex shape, being formed nonuniformly in the radial direction, tend to have low tensile strengths. On the other hand, with fibers having a circular cross-section, fiber formation has been achieved evenly both on the surface and in the inside part. The water soluble fibers of the present invention therefore preferably have a circular cross-section.

The process for producing water soluble fibers according to the present invention is now described. The raw material polymers usable in the present invention are, as described before, PVA-based ones which have a water dissolution temperature after being formed into fiber of 0° to 100° C. In the present invention, any one of these polymers is dissolved in an organic solvent capable of dissolving the polymer, to prepare a spinning dope. Any organic solvent that can dissolve the polymer can be used with no specific limitation and its examples are polar solvents such as DMSO, dimethylacetamide, dimethylformamide and N-methylpyrrolidone; polyhydric alcohols such as glycerin and ethylene glycol, mixtures of the foregoing with a swellable metal salt such as rhodanate, lithium chloride, calcium chloride or zinc chloride; mixtures of the foregoing with each other and mixtures of the foregoing with water.

Among the above solvents, DMSO is particularly preferred in view of low-temperature solubility, low toxicity, low corrosive properties and like advantages. Where a PVA having a low saponification degree and containing many vinyl acetate units is used as a raw material in the present invention, if the spinning dope is highly acid or alkaline, the PVA will undergo saponification during dissolution and deaeration, thereby causing the resulting fiber to have a water dissolution temperature exceeding 100° C. Addition of a strong base such as sodium hydroxide or a strong acid such as sulfuric acid should therefore be avoided. However, such saponification does not occur in a DMSO solution or under weakly alkaline conditions such as caused by addition of sodium acetate or under weakly acid conditions. Addition of an alkaline or acid substance is therefore permitted, as long as the dope is maintained within the range of weakly alkaline to weakly acid conditions. Where a PVA-based polymer having ionic groups such as carboxylic acid or sulfonic acid is used, sodium hydroxide may be added to the spinning dope to neutralize hydrogen ions and to adjust the acidity of the dope. The concentration of the PVA-based polymer used may vary depending on the dope composition, degree of the polymerization of the polymer and solvent, but it is generally in a range of 6 to 60% by weight. Dissolution is desirably carried out after the air in the system has been replaced by nitrogen and under reduced pressure, with stirring. This method effectively prevents occurrence of oxidation, decomposition and crosslinking reactions and suppresses foaming. When the spinning dope thus prepared is next extruded through spinnerets, the dope temperature is preferably selected such that the dope does not gel and from the range of 40° to 170° C.

The spinning dope obtained is wet spun or dry-jet-wet spun into a solidifying bath principally comprising an organic solvent which solidifies the polymer, i.e. solidifying solvent. The term "solidify" herein means that a spinning dope having flowability changes into a solid having no flowability and thus includes both "gels" which are defined a solidification which is not accompanied by change in the dope composition and "coagulates" which are defined as a solidification which is accompanied by change in the dope composition.

In the present invention, examples of usable solidifying agents are alcohols such as methanol, ethanol, propanol and butanol, ketones such as acetone, methyl ethyl ketone and methyl isobutyl ketone, aliphatic esters such as methyl acetate and ethyl acetate, aromatic solvents such as benzene and toluene and mixtures of two or more of the foregoing. It is also possible that the solidifying bath be a mixture of one of the above solvents with the solvent used for the spinning dope. In particular, it is desirable to use, for PVA-based polymers modified only to a small extent, a solidifying bath comprising a mixture of methanol and the solvent for the dope, and, for those modified to a large extent or those having low degree of saponification, a solidifying bath comprising a mixture of the solvent for the dope and, for example, methyl ethyl ketone or acetone, since methanol has insufficient solidifying force in the latter case. In the above cases, the mixing ratio by weight of solidifying solvent/dope solvent is preferably in a range of 95/5 to 40/60, more preferably in a range of 90/10 to 50/50 and most preferably in a range of 85/15 to 55/45. Mixing the dope solvent into the solidifying bath used can facilitate adjustment of the solidifying force, as well as, decreasing the cost for separating and recovering dope solvent and solidifying solvent.

Although there is no specific limitation to the temperature of the solidifying bath used, the temperature is generally in a range of −20° to 30° C. In view of uniform solidification and energy saving, the temperature is preferably in a range of −10° to 20° C., more preferably in a range of −5° to 15° C. and most preferably in a range of 0° to 10° C. Either too high a temperature or too low a temperature decreases the tensile strength of the obtained fiber.

The spinning dope has, as described above, been heated up to a considerably high temperature. Introduction of the spinning dope into a solidifying bath therefore would elevate the temperature of the bath above 30° C. In order to maintain the bath temperature below 30° C., it then becomes necessary to cool the bath.

As the spinning process used for the process of the present invention, there may be employed either wet spinning or dry-jet-wet spinning and the spinning conditions are suitably set according to the spinning process employed. However, for extruding a spinning dope through multi-hole spinnerets, wet spinning is more effective than dry-jet-wet spinning in preventing the extruded streams from sticking to each other. Wet spinning herein means a process which comprises extruding a spinning dope directly into a solidifying bath, while dry-jet-wet spinning means a process which comprises extruding a spinning dope at first into a gaseous atmosphere such as air or inert gas and then introducing the extruded streams into a solidifying bath.

The filaments solidified in the bath are then wet drawn in a ratio of 2 to 8, through a wet drawing bath comprising the solidifying solvent or mixtures thereof with the dope solvent. In order to suppress sticking together of the filaments, it is important to draw in as high a ratio as possible as long as fluffs are not generated. With a wet draw ratio of less than 2, filament sticking tends to occur. At a ratio exceeding 8, fluffs tend to form. The wet draw ratio is preferably 3 to 6. Maintaining the temperature of the wet drawing bath near the boiling point is effective in achieving high draw ratio. It is also effective to conduct multi-stage wet drawing in 2 or more stages. Examples of liquids usable for the wet drawing bath are the same as those for the solidifying bath.

The filaments thus wet drawn are then contacted with an extracting bath principally comprising the solidifying bath to remove the dope solvent by extraction. Upon extraction, the dwell time in the extracting bath can be shortened by allowing the pure solidifying solvent to flow continuously and counter-currently in the passing direction of the filaments. By this extraction, the content of the dope solvent present in the filaments decreases down to not more than 1%, preferably not more than 0.1%. The contact time is preferably at least 5 seconds, more preferably at least 15 seconds. In order to increase the extraction rate and conduct effective extraction, it is desirable to maintain the temperature of the extracting solvent at an elevated level near the boiling point. In the manufacture of conventional PVA-based fibers, it is a general practice to, after wet drawing, directly dry the filaments without removing the dope solvent by extraction. However, in the present invention, where filaments tend to stick together readily, the above conventional practice should create inter-filament sticking upon drying. The solvent extraction process is therefore very important in the process of the present invention.

The filaments after extraction are then dried under a gaseous atmosphere at a temperature of not more than 150° C. In order to effectively prevent sticking of the filaments a hydrophobic oil selected from mineral-based oils, silicone oils, fluorine-based oils and the like, are applied to the film. Alternatively the filaments are shrunk during drying to relax shrinking stress. The dried as-spun filaments thus obtained are, as necessary, dry heat drawn in a ratio of 1.1 to 6 at a temperature appropriately selected from the range of from 80 to 220° C.

The filaments thus dried or further dry heat drawn are then subjected to dry heat shrinking treatment, which is most important in the process of the present invention. Furthermore, in the present invention, the dry heat shrinking treatment is conducted in multiple stages, under a condition of multiple stage temperature elevation. Employment of this multi-stage temperature elevation condition realizes uniform shrinkage of the filaments, thereby providing .them with a high-level dimensional stability under high humidities and small shrinkage upon dissolution in water, and prevents the filaments from sticking together. In general, water soluble fibers more readily undergo inter-filament sticking and non-uniform shrinkage as compared to conventional insoluble fibers. However, the shrinking treatment under multi-stage temperature elevation conditions employed in the present invention is very effective in providing uniform shrinkage without causing inter-filament sticking.

It is desirable to conduct the shrinking treatment under multi-stage temperature conditions in 2 to 4 stages, each stage having a temperature 5° to 80° C. higher than the preceding stage. For example, with a 2-stage treatment, it is desirable to set the temperature in the first stage at 80° to 190° C. and that in the second stage at 100° to 220° C., the latter being higher than the former by 5° to 80° C. With a 3-stage treatment, it is desirable that the temperatures at the first, second and third stage be 80° to 160° C., 100° to 190° C. and 110° to 220° C., respectively, the temperature increasing by 5° to 60° C. between the stages.

The term "multi-stage" as referred to in the present invention includes (i) a treatment in which each stage is separated from adjacent stages by rolls or the like so that the shrinking tension at each stage can be controlled independently and (ii) a treatment in which each stage is continuous with successive stages without the presence of rolls or the like and the tension at each stage cannot be changed independently.

The shrinking treatment under multi-stage temperature conditions, employed in the process of the present invention, can subject the filaments to successive shrinkages according to the employed temperatures, thereby providing a uniform shrinkage without causing inter-filament sticking.

The dry heat shrinkage treatment is conducted to give a total shrinkage of 3 to 40% at temperatures of 80° to 240° C. A temperature of less than 80° C. or a total shrinkage of less than 3% cannot sufficiently produce the effect of improving the dimensional stability under high-humidity conditions or decreasing the shrinkage upon dissolution in water. On the other hand, a temperature exceeding 240° C. or a total shrinkage exceeding 40% deteriorates the treated filaments or causes them to stick together.

Polymer molecules present in a filament which has been wet drawn and oriented in the direction of filament axis have internal strain. When the filament absorbs moisture under high humidity or absorption of water upon immersion in water, these molecules become more mobile and tend to shrink to relax the strain. If filaments after being dried in the course of the process of the present invention are not subjected to shrinkage treatment, they shrink to a large extent under high humidity or upon absorption of water, thus being of poor dimensional stability. However, with the filaments further dry heat shrunk under the above conditions, little shrinking occurs when the filaments are placed under high humidity or even when they are heated in water at a temperature up to near the water dissolution temperature, which shows marked improvement of dimensional stability. This is considered to be due to the fact that the above strain has been relaxed by the dry heat shrinking treatment. To relax the strain more completely, the heat shrinkage treatment conditions should be appropriately selected according to the glass transition temperature and melting point of the polymer and the draw ratio of the filaments, and it is generally recommended to employ a multi-stage temperature elevation in a range of 120° to 240° C. to a total shrinkage of 6 to 40%.

The filaments thus heat shrunk are then either taken up as a multifilament yarn, or are further processed into nonwoven fabrics by a spunbonding process or into staple form to be spun into spun yarns or processed into dry-laid nonwoven fabrics. In the fibers of the present invention thus obtained, the water soluble PVA-based polymer used, having been subjected to organic solvent based dope-low temperature bath gel spinning, is solidified uniformly throughout the cross-section while forming fine crystals. The fibers have, if they have been extruded through circular-hole spinnerets, circular cross-section. The polymer molecules constituting the fibers, upon wet drawing and dry heat drawing, have been oriented and crystallized uniformly in the radial direction and the orientation is then sufficiently relaxed by undergoing dry heat shrinkage. On the other hand, with conventional fibers obtained by wet spinning or dry spinning in what is known as an aqueous system, only the fiber surface has undergone excess orientation, whereby these fibers are provided on the surface thereof with deep grooves having a depth of at least 0.2μ and a length of at least 3μ, i.e. what are known as longitudinal stripes, in the direction of fiber axis. The fibers of the present invention have a structural feature that they are not provided on the surfaces thereof with these longitudinal stripes, which realizes the characteristics of the fibers of the present invention, i.e. high tensile strength, good dimensional stability and good solubility. The presence of longitudinal stripes on the surface of a fiber is observable by taking electron microphotographs with a magnification of 2,000 to 6,000. The depth of the stripes can be determined by measurement on the photograph of the fiber cross-section, while the length is determined by measurement of the fiber surface. Whether the orientation crystallization is uniform in the radial direction of a fiber can readily be judged by observation of the fiber cross-section under an optical microscope. That is, conventional PVA-based fibers, the surface of which has solidified more rapidly than the inside, have dense surface structure and coarse inside structure. When the cross-section of this type fiber is observed under an optical microscope, the surface part looks brighter because of large light transmittance while the inside looks darker because of light scattering. On the other hand, the fiber of the present invention, having a uniform cross-sectional structure, shows no difference in brightness between the surface and the inside.

As so far described, the process of the present invention comprises wet spinning or dry-jet-wet spinning a PVA-based polymer soluble in water at not more than 100° C. while using a dope solvent and a solidifying solvent each comprising an organic solvent, wet drawing the as-spun filaments, subjecting the drawn filaments to extraction treatment and then drying, to obtain filaments having radially uniform structure, and subjecting the filaments, or those further dry heat drawn, to heat shrinkage treatment under multistage temperature conditions. The water soluble fibers of the present invention obtained by this process, while having a low water dissolution temperature of not more than 100° C., have a markedly low maximum shrinkage in water and have high tensile strength and small ash content. This type of water soluble fibers has never been obtained before, by conventional dry spinning, wet spinning or dry-jet-wet spinning.

Among the PVA-based fibers of the present invention, those having a water dissolution temperature of not more than 40° C. have the feature of firmly bonding with each other by heat pressing. These fibers can, by utilizing the feature, be formed into a web, which is then heat embossed to form a nonwoven fabric directly. For example, a nonwoven fabric obtained by forming endless filaments according to the present invention into a web by a spunbonding process and then heat embossing the web is water soluble and has good dimensional stability upon moisture absorption or dissolution in water, and has high tensile strength, thus being most suited as a chemical lace base fabric. Furthermore, since the fibers can be bonded by heat embossing, heat pressing can bond together 2 or more layers of a woven or knit fabric or nonwoven fabric comprising the fibers, or such fabrics with a heat bondable plastic film, so that a variety of large-width materials, bag-shaped ones and laminates can readily be prepared.

Other features of the invention will become more apparent in the course of the following detailed descriptions of exemplary embodiments which are given for illustration of the invention and are not intended to be limiting thereof.

EXAMPLE 1

A partially saponified PVA having a degree of polymerization of 1,700 and a degree of saponification of 95 mole % was mixed with DMSO. The air in the vessel was replaced by nitrogen and the mixture was dissolved by stirring for 8 hours under a reduced pressure of 110 Torr and at 90° C. The solution was deaerated for 8 hours under the same 110 Torr at 90° C., to give a 20% solution of the PVA in DMSO. The spinning dope thus prepared was, while being maintained at a temperature of 90° C., wet spun through a spinneret with 400 holes having a diameter of 0.08 mmϕ into a coagulating bath kept at 3° C. and comprising a 75/25 by weight mixture methanol/DMSO. The filaments solidified were wet drawn in ratio of 5 through a wet drawing bath comprising a 96/4 by weight mixture of methanol/DMSO at 40° C. The wet drawn filaments were contacted countercurrently with heated methanol, to extract DMSO, and then provided with 1%/polymer of a mineral oil-based finish and dried through a hot air oven at 120° C., to give 1000 dr/400 fil. as-spun multifilament yarn. The yarn was then subjected to 3-stage temperature elevation heat shrinkage treatment through a hot air oven consisting of 3 sections at a temperature gradient of 150° C.–170° C.–190° C. in a total shrinkage of 20%.

The yarn thus obtained had a low water dissolution temperature (T) of 45° C., a very small dimensional change ratio S at 20° C., 93% RH of 1% and a very small ash content of 0.05%. The tensile strength and maximum shrinkage in water were found to be 4.8 g/d and 5%, respectively. Filaments constituting the yarn had a circular cross-section and the cross-section was of uniform structure. Observation on the filament surface in an electron microscope revealed that there was substantially no longitudinal stripes having a depth of at least 0.2μ and a length of at least 3μ.

Comparative Example 1

The as-spun multifilament yarn before the dry heat shrinkage treatment of Example 1 was sampled and studied. While the sample showed a low water dissolution temperature (T) of 28° C., it had a large dimensional change ratio S under 93% RH of 15%, thus being of insufficient dimensional stability.

Comparative Example 2

The procedure for obtaining as-spun yarn of Example 1 was repeated except that a partially saponified PVA having a degree of polymerization of 1,370 and a degree of saponification of 93.6 mole % was used, that the PVA concentration was set at 28% and that the wet drawing ratio was 6, to obtain a 1000 d/400 f as-spun yarn. The yarn was dry heat drawn in a ratio of 2 through a hot air oven comprising 2 sections of 140° C.–170° C. The thus obtained yarn had a large dimensional change ratio S under 93% RH of 23%, while it had a low water dissolution temperature (T) of only 20° C.

EXAMPLE 2

The drawn yarn obtained in Comparative Example 2 was subjected to 2-stage temperature elevation shrinkage treatment to a total shrinkage of 25% through a hot air drying oven comprising 2 sections of 150° C.–180° C. The yarn thus treated had a significantly improved dimensional change ratio S under 93% RH of 2%, while it showed an increased water dissolution temperature (T) of only 24° C. The yarn had a markedly small ash content of 0.03%, and a tensile strength of 5.1 g/d and a maximum shrinkage in water of 2%. Filaments constituting the yarn had a circular cross-section with radially uniform structure. Observation on the filament surface in an electron microscope revealed that there were substantially no longitudinal stripes having a depth of at least 0.2μ and a length of at least 3μ.

EXAMPLE 3

A partially saponified PVA having a degree of polymerization of 1,700 and a degree of saponification of 98.5 mole % was mixed with DMSO. The air in the vessel was replaced by nitrogen and the mixture was dissolved by stirring for 8 hours under a reduced pressure of 110 Torr and at 90° C. The solution was deaerated for 8 hours under the same 110 Torr pressure at 90° C., to give a 19% solution of the PVA in DMSO. The spinning dope thus prepared was, while being maintained at a temperature of 90° C., wet spun through a spinneret with 400 holes having a diameter of 0.10 mmϕ into a coagulating bath kept at 2° C. and comprising a 70/30 by weight mixture of methanol/DMSO. The filaments solidified were wet drawn in a ratio of 5.5 through a wet drawing bath comprising a 95/5 by weight mixture of methanol/DMSO at 45° C. The wet drawn filaments were contacted countercurrently with heated methanol, to extract DMSO, and then dried through a hot air oven at 120° C., to give 1500 dr/400 f as-spun multifilament yarn. The yarn was then subjected to 2-stage temperature elevation heat shrinkage treatment through a hot air oven consisting of 2 sections of 150° C.–220° C. in a total shrinkage of 12%.

The yarn thus obtained had a water dissolution temperature (T) of 88° C. and a small maximum shrinkage in water of 4%. The tensile strength, elongation and toughness were 5.2 g/d, 20% and 52 g/d×%, respectively, and the dimensional change ratio S at 20° C., 93% RH was as low as 0.6%, thus exhibiting excellent dimensional stability. Filaments constituting the yarn had a circular cross-section with uniform structure. The ash content was 0.03%, which was markedly small. The obtained yarn was tested for degree of saponification of constituting polymer, which was found to be 98.4 mole %, i.e. identical with that of the raw material PVA. Observation of the filament surface in an electron microscope revealed that there was substantially no longitudinal stripes having a depth of at least 0.2μ and a length of at least 3μ.

Comparative Example 3

The as-spun multifilament yarn before the dry heat shrinkage treatment of Example 3 was sampled and studied. While the sample showed a water dissolution temperature (T) of 61° C., it had a large maximum shrinkage in water of 52%, thus exhibiting a large dimensional change upon dissolution.

Comparative Example 4

Example 3 was repeated except that, instead of the dry heat shrinkage treatment, constant-length heat treatment (shrinkage=0%) was conducted, to obtain a yarn. The yarn showed a water dissolution temperature (T) of 88° C. and a large maximum shrinkage in water of 25%.

Comparative Example 5

The procedure for obtaining as-spun yarn of Example 3 was repeated except that a completely saponified PVA having a degree of polymerization of 1,750 and a degree of saponification of 99.9 mole %, to resulted in a 1500 d/400 f as-spun yarn. The yarn was then dry heat shrunk in the same manner as in Example 3. The thus obtained yarn did not dissolve in water at 100° C.

Comparative Example 6

The as-spun yarn obtained in Example 3 was further dry heat drawn in a ratio of 2.3 through a hot air oven of 150° C.– 200° C. The drawn yarn thus obtained had a water dissolution temperature (T) of 75° C. and a large maximum shrinkage in water of 50%.

EXAMPLE 4

The drawn yarn obtained in Comparative Example 6 was dry heat shrunk through a hot air oven under a 2-stage temperature condition of 150° C.–220° C. The yarn thus obtained had a water dissolution temperature (T) of 93° C. and a small maximum shrinkage in water of 6%. The tensile strength, elongation and toughness were 7.5 g/d, 15% and 56 g/d×%, respectively, and the dimensional change ratio S under 93% RH was as low as 0.2%. Thus the yarn exhibited excellent dimensional stability. Filaments constituting the yarn had a circular cross-section with uniform structure. The ash content was 0.04%, which was markedly small. Observation of the filament surface in an electron microscope revealed that there was substantially no longitudinal stripes having a depth of at least 0.2μ and a length of at least 3μ.

EXAMPLE 5

The procedure for obtaining as-spun yarn of Example 3 was repeated except that a PVA having a degree of polymerization of 1,700 and a degree of saponification of 97 mole % was used. The as-spun yarn obtained was dry heat shrunk to a total shrinkage of 20% through a hot air oven consisting of 3 sections under 3-stage temperature elevation condition of 150° C.–170° C.–200° C. The yarn thus obtained had a water dissolution temperature (T) of 65° C. and a small maximum shrinkage in water of 9%. The tensile strength, elongation and toughness were 5.1 g/d, 31% and 79 g/d×%, respectively, and the dimensional change ratio S under 93% RH was as low as 0.7%, thus exhibiting excellent dimensional stability. Filaments constituting the yarn had a circular cross-section with uniform structure. The ash content was 0.02%, which was very small. Observation of the filament surface in an electron microscope revealed that there was substantially no longitudinal stripes having a depth of at least 0.2μ and a length of at least 3μ.

EXAMPLE 6

The procedure for obtaining as-spun yarn of Example 3 was repeated except that a PVA having a degree of saponification of 96.5 mole % was used. The as-spun yarn obtained was dry heat shrunk to a total shrinkage of 20% through a 2-stage temperature elevation hot air oven consisting of 2 sections of 150° C.–180° C., and, further heat shrunk to a shrinkage of 15% through a 2-stage temperature elevation hot air oven consisting of 2 sections of 150° C.–200° C. The yarn thus obtained had a water dissolution temperature (T) of 61° C. and a small maximum shrinkage in water of 8%. The tensile strength, elongation and toughness were 4.8 g/d, 32% and 77 g/d×%, respectively, and the dimensional change ratio S under 93% RH was as low as 0.6%, thus exhibiting excellent dimensional stability. Filaments constituting the yarn had a circular cross-section with uniform structure. The ash content was 0.02%, which was very small. Observation on the filament surface in an electron microscope revealed that there was substantially no longitudinal stripes having a depth of at least 0.2μ and a length of at least 3μ.

EXAMPLE 7

A partially saponified PVA having a degree of polymerization of 500 and a degree of saponification of 98.5 mole % was mixed with DMSO. The air in the vessel was replaced by nitrogen and the mixture was dissolved by stirring for 11 hours under a reduced pressure of 110 Torr and at 110° C. The solution was deaerated for 8 hours under the same 110 Torr at 110° C., to give a 35% solution of the PVA in DMSO. The spinning dope thus prepared was cooled to a temperature of 100° C. just before the spinning head, and dry-jet-wet spun through a spinneret with 60 holes having a diameter of 0.08 mmϕ via a 5 mm-thick air layer into a coagulating bath kept at 5° C. and comprising a 65/35 by weight mixture of methanol/DMSO. The filaments solidified were wet drawn in a ratio of 6 through a wet drawing bath comprising a 95/5 by weight mixture of methanol/DMSO at 40° C. The wet drawn filaments were subjected to extraction in methanol to remove DMSO, and then dried through a hot air oven at 120° C., to give 150 dr/60 f as-spun multifilament yarn. The yarn was dry heat drawn in a ratio of 2 through a hot air oven consisting of 2 sections of 150° C.–215° C. and then dry heat shrunk under 2-stage temperature elevation condition of 180° C.–225° C. to a shrinkage of 25%.

The yarn thus obtained had a water dissolution temperature (T) of 83° C. and a small maximum shrinkage in water of 5%. The tensile strength, elongation and toughness were 4.7 g/d, 20% and 47 g/d×%, respectively, and the dimensional change ratio S at 20° C., 93% RH was as low as 0.2%, thus exhibiting excellent dimensional stability. Filaments constituting the yarn had a circular cross-section with uniform structure. The ash content was 0.03%, which was very small. Observation of the filament surface in an electron microscope revealed that there was substantially no longitudinal stripes having a depth of at least 0.2μ and a length of at least 3μ.

Obviously, numerous modifications and variations of the invention are possible in light of the above teachings. It is therefore to be understood that within the scope of the appended claims, the invention may be practiced otherwise than as specifically described herein.

What is claimed is:

1. A water soluble homo- or copolymeric polyvinyl alcohol fiber having a surface, a water dissolution temperature (T° C.) of 0° to 100° C., a maximum shrinkage in water of not more than 20%, a tensile strength of at least 3 g/d, an ash content of not more than 1% and a dimensional change ratio (S)% at 20° C. 93% relative humidity satisfying the following conditions:

when $0 \leqq T \leqq 50$, $S \leqq 6-(T/10)$, and when $50 < T \leqq 100$, $S \leqq 1$.

2. The fiber according to claim 1, wherein said fiber has a circular cross-section and the surface of said fiber has substantially no grooves having a depth of at least 0.2μ and a length of at least 3μ.

3. The fiber according to claim 1, wherein said fiber comprises a polyvinyl alcohol having a degree of saponification of 80 to 96 mole % and has a water dissolution temperature (T° C.) of 0° to 60° C.

4. The fiber according to claim 1, wherein said fiber comprises a polyvinyl alcohol having a degree of saponification of 96 to 99.5 mole % and has a water dissolution temperature (T° C.) of 60° to 100° C.

5. The fiber according to claim 1, having a tensile strength of at least 4 g/d.

* * * * *